US010213934B2

(12) United States Patent
Capoia

(10) Patent No.: US 10,213,934 B2
(45) Date of Patent: Feb. 26, 2019

(54) CUTTING DEVICE FOR CUTTING RELATIVELY RIGID WEB MATERIALS SUCH AS PAPER, CARDBOARD, PLASTIC MATERIALS OR COMPOSITES

(71) Applicant: PANOTEC S.R.L., Cimadolmo (IT)

(72) Inventor: Giuseppe Capoia, Cimadolmo (IT)

( * ) Notice: Subject to any disclaimer, the term of this patent is extended or adjusted under 35 U.S.C. 154(b) by 46 days.

(21) Appl. No.: 15/314,486

(22) PCT Filed: Jul. 2, 2015

(86) PCT No.: PCT/IB2015/054979

§ 371 (c)(1),
(2) Date: Nov. 28, 2016

(87) PCT Pub. No.: WO2016/001866

PCT Pub. Date: Jan. 7, 2016

(65) Prior Publication Data

US 2017/0274547 A1 Sep. 28, 2017

(30) Foreign Application Priority Data

Jul. 2, 2014 (IT) ..... UD2014A0115

(51) Int. Cl.

| | |
|---|---|
| ***B26D 1/14*** | (2006.01) |
| ***B26D 1/15*** | (2006.01) |
| ***B26D 1/157*** | (2006.01) |
| ***B26D 1/22*** | (2006.01) |
| ***B26D 11/00*** | (2006.01) |
| *B26D 3/08* | (2006.01) |
| *B26D 5/04* | (2006.01) |

(52) U.S. Cl.

CPC ..... *B26D 1/141* (2013.01); *B26D 1/151* (2013.01); *B26D 1/1575* (2013.01); *B26D 1/225* (2013.01); *B26D 11/00* (2013.01); *B26D 3/08* (2013.01); *B26D 3/085* (2013.01); *B26D 5/04* (2013.01)

(58) Field of Classification Search

CPC ..... B26D 1/141; B26D 11/00; B26D 1/1575; B26D 3/08

See application file for complete search history.

(56) References Cited

U.S. PATENT DOCUMENTS 2,609,049 A * 9/1952 Rayburn ..... B26D 3/003 225/2
3,289,662 A * 12/1966 Garrison ..... B23D 45/024 125/14

(Continued)

FOREIGN PATENT DOCUMENTS

DE 102008005775 7/2009
JP H0280234 3/1990

(Continued)

*Primary Examiner* — Sean M Michalski
(74) *Attorney, Agent, or Firm* — Themis Law

(57) ABSTRACT

A cutting device and corresponding method for cutting a relatively rigid material, such as for example paper, cardboard, plastic material, composite or other. The cutting device includes a first cutting disc sharpened along its peripheral edge and rotating around a first axis of rotation. A second cutting disc, also sharpened along its peripheral edge and rotating around a first axis of rotation (X3), is disposed in front of the first cutting disc with respect to the material and is co-planar with the first cutting disc (14).

6 Claims, 5 Drawing Sheets

(56) References Cited

U.S. PATENT DOCUMENTS 3,884,102 A * 5/1975 Faltin ..... B26D 1/245 83/152
3,890,868 A * 6/1975 Pickler ..... B26D 1/205 83/408
4,041,813 A * 8/1977 Spencer ..... B26D 1/16 83/14
4,210,042 A * 7/1980 Felten ..... B26D 11/00 83/49
4,373,302 A * 2/1983 Darby ..... B24B 3/46 451/285
4,688,540 A * 8/1987 Ono ..... B27B 31/06 125/13.01
4,706,535 A * 11/1987 Ducharme ..... B23D 45/068 144/3.1
4,813,319 A * 3/1989 Weyand, Jr. ..... B29D 30/46 83/168
4,817,581 A * 4/1989 Trentadue ..... B23D 45/024 125/14
4,858,505 A * 8/1989 Still ..... B29D 30/46 83/171
4,907,920 A * 3/1990 Lund ..... B23C 5/00 407/2
4,942,798 A * 7/1990 Taub ..... B23D 15/06 83/636
5,090,281 A * 2/1992 Paulson ..... B24B 3/368 83/13
5,159,870 A * 11/1992 Fiala ..... B23D 45/105 144/3.1
5,664,553 A * 9/1997 Chiuminatta ..... B28D 1/045 125/13.01
5,724,740 A * 3/1998 Bishop ..... B23D 45/102 30/375
5,901,631 A * 5/1999 Minarovic ..... B23D 47/025 144/3.1
5,946,996 A * 9/1999 Oussani, Jr. ..... B43M 7/02 83/425
5,979,525 A * 11/1999 Durney ..... B23D 47/12 144/136.95
6,298,561 B1 * 10/2001 Decker ..... B26B 29/06 30/265
6,428,651 B1 * 8/2002 Princell ..... B26D 3/001 156/259
6,510,773 B1 * 1/2003 Hart ..... B26D 3/02 156/405.1
6,976,516 B2 * 12/2005 Hale ..... B27L 11/005 144/174
7,100,486 B2 * 9/2006 Akins ..... B26D 3/20 83/404.1
7,240,598 B2 * 7/2007 Wang ..... B23D 45/105 144/3.1
7,654,182 B2 * 2/2010 Kawai ..... B26D 1/245 83/500
8,152,600 B2 * 4/2012 Bagley ..... B24D 15/06 451/45
8,210,082 B2 * 7/2012 Elhaus ..... B23D 45/105 83/471
8,281,696 B2 * 10/2012 McAdoo ..... B27B 5/207 83/424
2011/0036220 A1 * 2/2011 Paulson ..... B26D 1/245 83/13
2011/0252937 A1 * 10/2011 Supe-Dienes ..... B26D 1/24 83/176
2016/0031114 A1 * 2/2016 DeLise, Jr. ..... B26D 1/205 83/341

FOREIGN PATENT DOCUMENTS

JP 2001162582 6/2001
WO 2010073269 7/2010

* cited by examiner

CUTTING DEVICE FOR CUTTING RELATIVELY RIGID WEB MATERIALS SUCH AS PAPER, CARDBOARD, PLASTIC MATERIALS OR COMPOSITES

FIELD OF THE INVENTION

The present invention concerns a cutting device for cutting relatively rigid materials such as for example paper, cardboard, plastic materials, composites or other, having one or more overlapping layers, with an overall thickness comprised between some tenths of a millimeter, and about 10 mm, in particular a minimum overall thickness of less than about 1 mm and a maximum of up to 10 mm, to make boxes for example.

BACKGROUND OF THE INVENTION

In the industrial field for the production of products, such as for example packaging boxes of various sizes, using a relatively rigid material, such as for example paper, cardboard, plastic material, composite or other, it is known to cut a flat sheet from a continuous strip of the chosen material, the flat sheet having a development which comprises all the walls of the product to be made by subsequent folding.

Known cutting machines, suitable for cutting the strip and making the sheet, normally comprise one or more cutting devices, each of which has a single cutting blade.

In particular a cutting device is known in which the cutting blade consists of a circular disc, sharpened along its peripheral edge and rotating around its axis of rotation. The diameter of the known disc is normally comprised between about 50 mm and about 150 mm, its thickness is comprised between about 1 mm and about 3 mm and the cutting angle is comprised between 30° and 90°.

The known cutting device has the disadvantage, however, that it is effective only when the material to be cut has a thickness of no more than about 3 mm, and is no longer effective when the thickness of the material exceeds this value, as nowadays happens more and more often in the field of production of large-size boxes, or other products made using pre-cut sheets.

In fact, with known cutting devices, it often happens that the cutting disc is not able to completely cut the material to be cut, that is, from side to side, because the peripheral cutting edge cannot pass through the whole thickness of the material, and it is therefore necessary to make a second working step to complete the cut, which entails an unacceptable increase in production costs.

Documents JP-A-2001162582, JP-A-H0280234 and DE-A-102008005775 describe cutting devices of a known type.

There is therefore a need to perfect a cutting device for cutting relatively rigid materials, such as for example paper, cardboard, plastic materials, composites or suchlike, which can overcome at least one of the disadvantages of the state of the art.

In particular, one purpose of the present invention is to obtain a cutting device that is able to cut effectively, completely and with a single working step, a relatively rigid material, such as for example paper, cardboard, plastic material, composite or other, having a thickness up to a maximum of about 10 mm.

Another purpose of the present invention is to perfect a method that allows to cut effectively, completely and with a single working step, a relatively rigid material, such as for example paper, cardboard, plastic material, composite or other, having a thickness up to a maximum of about 10 mm, using, among other things, a cutting disc of the known type.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purposes, a cutting device for cutting a relatively rigid material, such as for example paper, cardboard, plastic material, composite or other, comprises a first cutting disc sharpened along its peripheral edge and rotating around its first axis of rotation.

According to one aspect of the present description, the cutting device also comprises at least a second cutting disc also sharpened along its peripheral edge, which is disposed in front of the first cutting disc with respect to the material to be cut and is co-planar with the first cutting disc. In this way, the axis of rotation of the second cutting disc is parallel to the axis of rotation of the first cutting disc.

The term "in front of" means that the second cutting disc is located in a front position with respect to the first cutting disc with respect to the direction of reciprocal feed of the material to be cut and the cutting device. In other words, during the cutting step the material to be cut meets first the second cutting disc and then the first cutting disc.

With this new and inventive characteristic, the cutting device according to the present invention has the advantage that it is able to cut effectively, completely and in a single working step, a relatively rigid material, such as for example paper, cardboard, plastic material, composite or other, having a thickness up to a maximum of about 10 mm, combining a second cutting disc with a first cutting disc of a known type, and coplanar therewith.

In fact, the simple but effective addition of a second cutting disc in front of the first cutting disc allows the second cutting disc to make a first incision, relatively deep, on the material to be cut, so that the first cutting disc meets the material already incised and can complete the cutting step in a totally effective way, because its peripheral cutting edge is inserted into the first incision made immediately before by the second cutting disc.

According to another aspect of the present description, the second cutting disc is sharper than the first cutting disc, so that the first incision is made as if the second cutting disc were a scalpel.

According to another aspect of the present description, the first cutting disc has a first diameter, a first thickness and a first cutting angle of its peripheral edge, while the second cutting disc has a second diameter, a second thickness and a second cutting angle of its peripheral edge, all preferably less than those of the first cutting disc.

According to another aspect of the present description, both the first cutting disc and the second cutting disc are mobile individually or together, with respect to a support plane on which the material to be cut is suitable to be rested, so that the distance between the peripheral cutting edge of each of the two cutting discs is selectively adjustable with respect to the support plane, for example as a function of the thickness of the material to be cut.

According to another aspect of the present description, the method for cutting a relatively rigid material, such as for example paper, cardboard, plastic material, a composite or other, comprises a first cutting step that provides that the material is cut by a first cutting disc sharpened along its peripheral edge and rotating around its first axis of rotation, and at least a second cutting step that provides that the material is first cut, that is, before said first cutting step takes place, by a second cutting disc, also sharpened along its peripheral edge and which is disposed in front of and co-planar with the first cutting disc.

According to one aspect of the method described here, the distance between the peripheral cutting edge of each of the cutting discs is selectively adjusted with respect to a support plane on which the material to be cut is rested, moving the first cutting disc and the second cutting disc individually or together, with respect to the support plane.

These and other aspects, characteristics and advantages of the present disclosure will be better understood with reference to the following description, drawings and attached claims. The drawings, which are integrated and form part of the present description, show some forms of embodiment of the present invention, and together with the description, are intended to describe the principles of the disclosure.

The various aspects and characteristics described in the present description can be applied individually where possible. These individual aspects, for example aspects and characteristics described in the attached dependent claims, can be the object of divisional applications.

It is understood that any aspect or characteristic that is discovered, during the patenting process, to be already known, shall not be claimed and shall be the object of a disclaimer.

BRIEF DESCRIPTION OF THE DRAWINGS

These and other characteristics of the present invention will become apparent from the following description, which is provided with the purpose of giving a better understanding of the invention. Together with the description, a series of drawings are also provided, which form an integral part of the description and show forms of embodiment of the present invention, which must not be interpreted as restrictive of the field of protection thereof, but only an example of how the present invention can be achieved. The drawings comprise the following figures.

Figure 1:
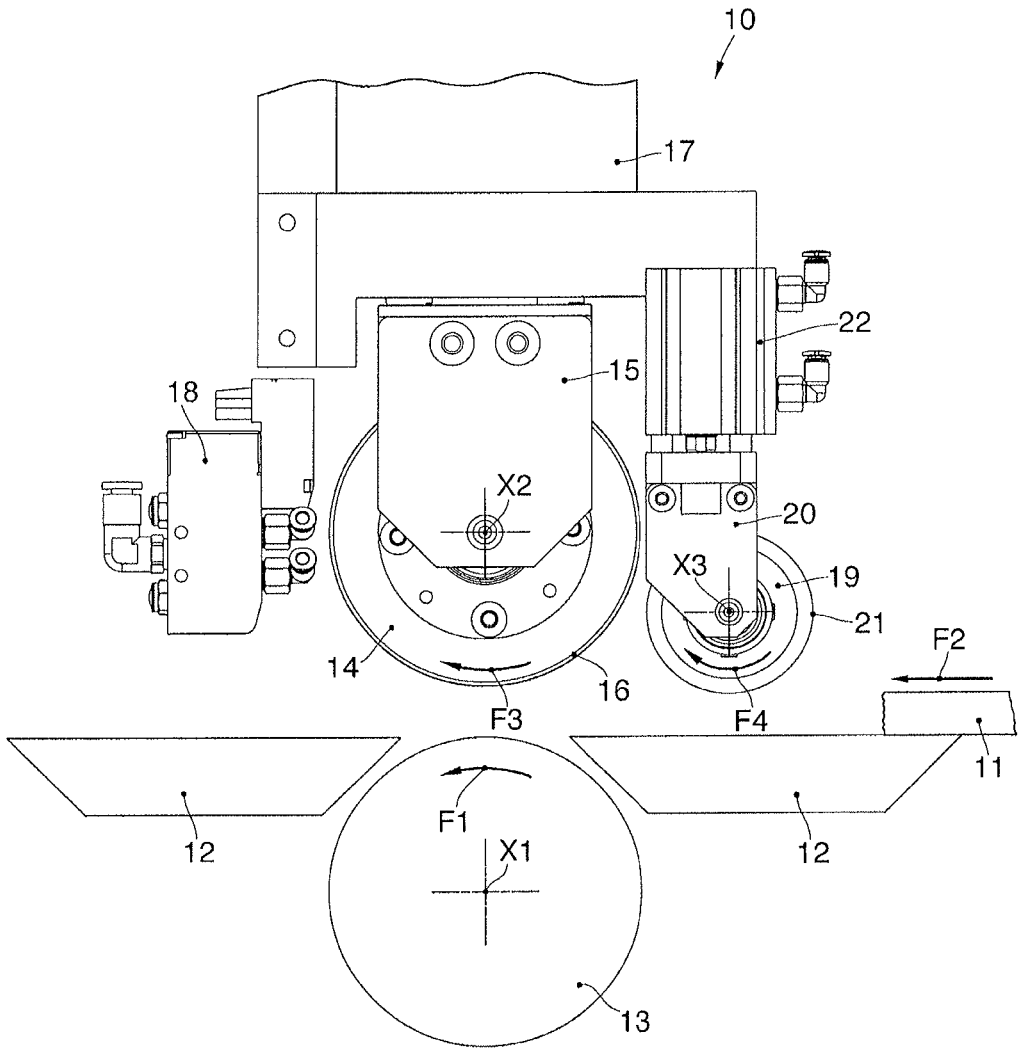
FIG. 1 is a lateral view of a cutting device according to the present invention in an inactive position.

To facilitate comprehension, the same reference numbers have been used, where possible, to identify identical common elements in the drawings. It is understood that elements and characteristics of one form of embodiment can conveniently be incorporated into other forms of embodiment without further clarifications.

DETAILED DESCRIPTION OF A FORM OF EMBODIMENT

We shall now refer in detail to the various forms of embodiment of the present invention, of which one or more examples are shown in the attached drawing. Each example is supplied by way of illustration of the invention and shall not be understood as a limitation thereof. For example, the characteristics shown or described insomuch as they are part of one form of embodiment can be adopted on, or in association with, other forms of embodiment to produce another form of embodiment. It is understood that the present invention shall include all such modifications and variants.

With reference to FIG. 1, a cutting device 10 according to the present invention is configured to cut a relatively rigid material 11, such as for example paper, cardboard, plastic material, a composite or other, having one or more overlapping layers, with an overall thickness comprised between some tenths of a millimeter, that is, less than 1 mm, up to a maximum of about 10 mm, for example to make boxes.

The cutting device 10 comprises a support plane 12, for example horizontal, on which the material 11 is suitable to be rested.

A feed roll 13 is disposed with its cylindrical surface tangent to the upper surface of the support plane 12 and is rotatable in the direction of rotation indicated by arrow F1 around an axis of rotation X1, commanded by a motor member of any known type, for example an electric motor, not shown in the drawings.

The feed roll 13, with the collaboration of presser rolls of a known type and not shown in the drawings, is able to make the material 11 advance along the support plane 12 in the direction of feed indicated by arrow F2.

A first cutting disc 14 is mounted rotatable with respect to a first support slider 15, around its axis of rotation X2, parallel to the axis of rotation X1 of the feed roll 13. The rotation of the first cutting disc 14 (arrow F3) occurs in the opposite direction to that of the feed roll 13 and is commanded by a drive member of any known type, not shown in the drawings, for example the same electric motor that commands the feed roll 13.

Figure 7:
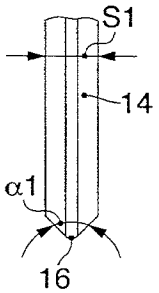
FIG. 7 shows a first enlarged detail of the cutting device in FIG. 1.

The first cutting disc 14 is the known type and has a diameter indicatively comprised between about 50 mm and about 150 mm, a thickness S1 (FIG. 7) comprised between about 1.5 mm and about 3 mm and a peripheral cutting edge 16 with a cutting angle $\alpha$1 comprised between about 60° and about 120°, preferably about 90°.

Figure 2:
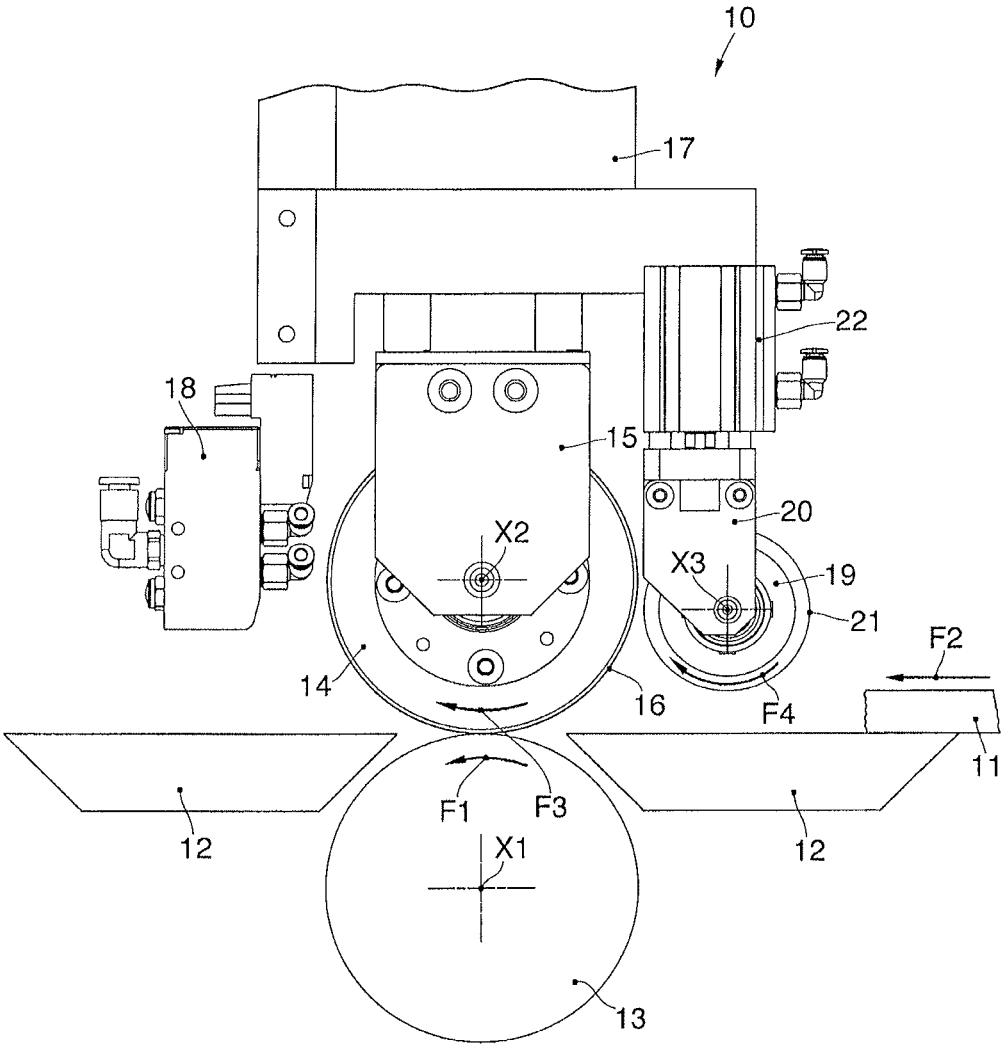
FIG. 2 is a lateral view of the cutting device in FIG. 1 in a first working position.

The first support slider 15 is mounted on a fixed structure 17 (FIG. 1) and is mobile with respect thereto in a direction perpendicular to the support plane 12, between an inactive position, in which the peripheral edge 16 of the first cutting disc 14 is distanced up to a maximum of about 10 mm, for example about 7 mm, 8 mm, 9 mm, 10 mm, from the upper surface of the support plane 12, and a working position (FIGS. 2 and 3), in which the peripheral edge 16 is in contact with the cylindrical surface of the feed roll 13.

A first pneumatic device 18 is configured to selectively command the movement in two directions of the first support slider 15 and of the first cutting disc 14 mounted on it.

A second cutting disc 19 is disposed coplanar to the first cutting disc 14 and in front of it with respect to the side on which the material 11 is introduced, that is, on the right in FIGS. 1 to 4.

The second cutting disc 19 is mounted rotatable with respect to a second support slider 20, around its axis of rotation X3, parallel to the axes of rotation X1 and X2. The rotation of the second cutting disc 19 (arrow F4) occurs in the same direction as the first cutting disc 14 and is commanded by a drive member of any known type, not shown in the drawings, for example the same electric motor that commands the feed roll 13.

Figure 8:
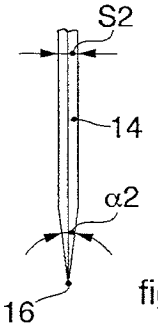
FIG. 8 shows a second enlarged detail of the cutting device in FIG. 1.
Figure 6:
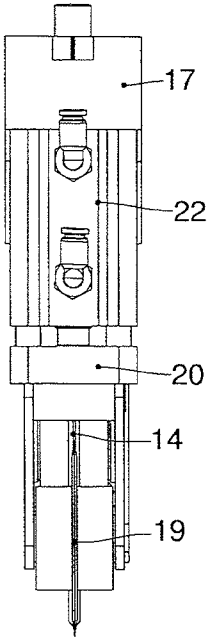
FIG. 6 is a part and transverse view of the cutting device in FIG. 1.
Figure 5:
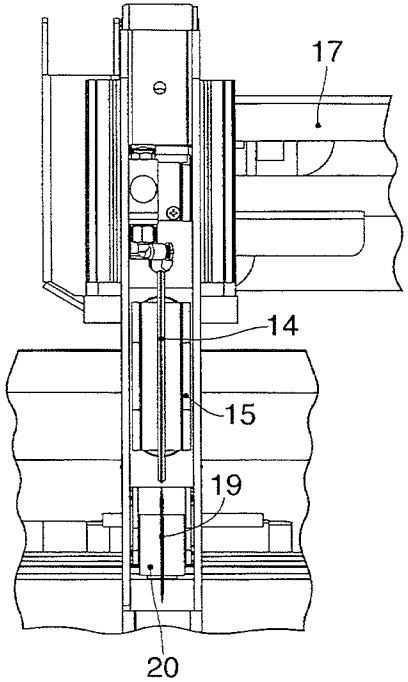
FIG. 5 is a part and plan view of the cutting device in FIG. 1.

The second cutting disc 19 is smaller and sharper than the first cutting disc 14, and indicatively has a diameter comprised between about 25 mm and about 100 mm, a thickness S2 (FIG. 8) comprised between about 0.5 mm and about 1 mm and a peripheral cutting edge 21 having a cutting angle $\alpha 2$ comprised between about 10° and about 30°, preferably about 15°.

The second support slider 20 is also mounted on the fixed structure 17 (FIG. 1) and is mobile with respect thereto in a direction perpendicular to the support plane 12, between an inactive position (FIGS. 1 and 2), in which the peripheral edge 21 of the second cutting disc 19 is distanced up to a maximum of about 10 mm, for example about 7 mm, 8 mm, 9 mm, 10 mm, from the upper surface of the support plane 12, and a working position (FIGS. 3 and 4), in which the peripheral edge 21 is positioned at a distance of about 1 mm from the upper surface of the support plane 12.

Advantageously, the first cutting disc 14 and the second cutting disc 19 are therefore mobile individually or together, with respect to a support plane 12 on which the material 11 to be cut is suitable to be rested, so that the distance between the peripheral cutting edge 16, 21 of each of the cutting discs 14, 19 is selectively adjustable with respect to the support plane 12. This solution gives flexibility in use, depending on the material to be cut.

A second pneumatic device 22 is configured to selectively command the movement in two directions of the second support slider 20 and the second cutting disc 19 mounted on it.

The cutting device 10 as described heretofore functions as follows.

In the inactive position (FIG. 1), the two cutting discs 14 and 19 are raised with respect to the support plane 12 and the material 11 is ready to be fed toward them using any known mean, either manually or mechanically, in the direction of arrow F2.

If the material 11 has a thickness of up to 3 mm, only the first pneumatic device 18 is driven, and only the first cutting disc 14 is lowered (first working position, shown in FIG. 2), as happens in cutting devices known in the state of the art.

On the contrary, if the material 11 has a thickness from 3 mm to a maximum of about 10 mm, first the second cutting disc 19 is lowered, driving the second pneumatic device 22, and subsequently the first cutting disc 14 is also lowered, driving the first pneumatic device 18, obtaining the second working position, shown in FIG. 3.

Figure 3:
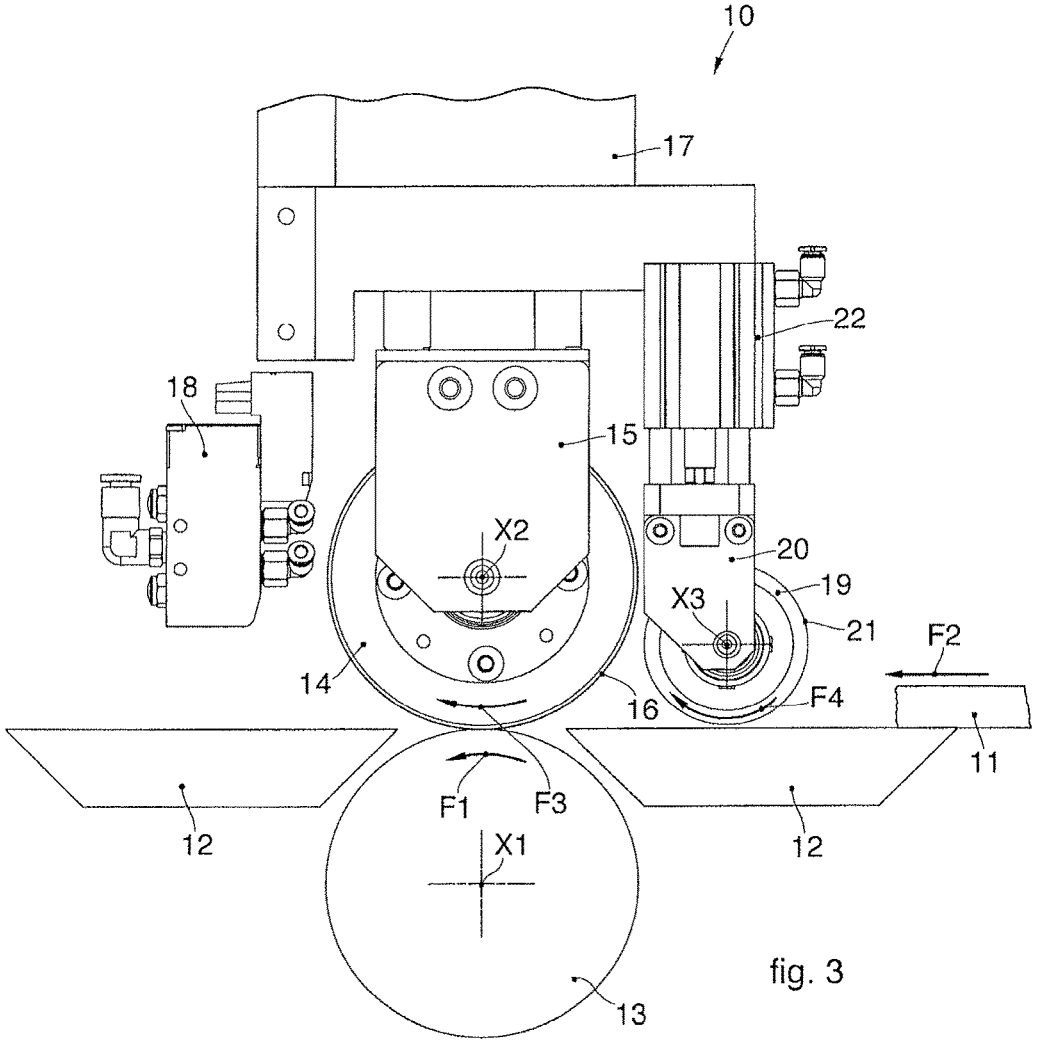
FIG. 3 is a lateral view of the cutting device in FIG. 1 in a second working position.

According to a variant, again if the material 11 has a thickness from 3 mm to a maximum of about 10 mm, together with the second cutting disc 19, the first cutting disc 14 can also be lowered, driving the second pneumatic device 22 and the first pneumatic device 18 simultaneously, obtaining in this variant too the second working position shown in FIG. 3.

In this second working position, the material 11, advancing toward the first cutting disc 14 in the direction of arrow F2, before it meets the first cutting disc 14, meets the second cutting disc 19 which, thanks to its very sharp peripheral edge 21, cuts the material 11 as if it were a scalpel. Immediately after, the first cutting disc 14 completes the cutting of the material 11, easily entering into the same incision made by the second cutting disc 19.

In this way, even if it has a thickness from 3 mm to a maximum of about 10 mm, the material 11 is cut perfectly and completely.

Figure 4:
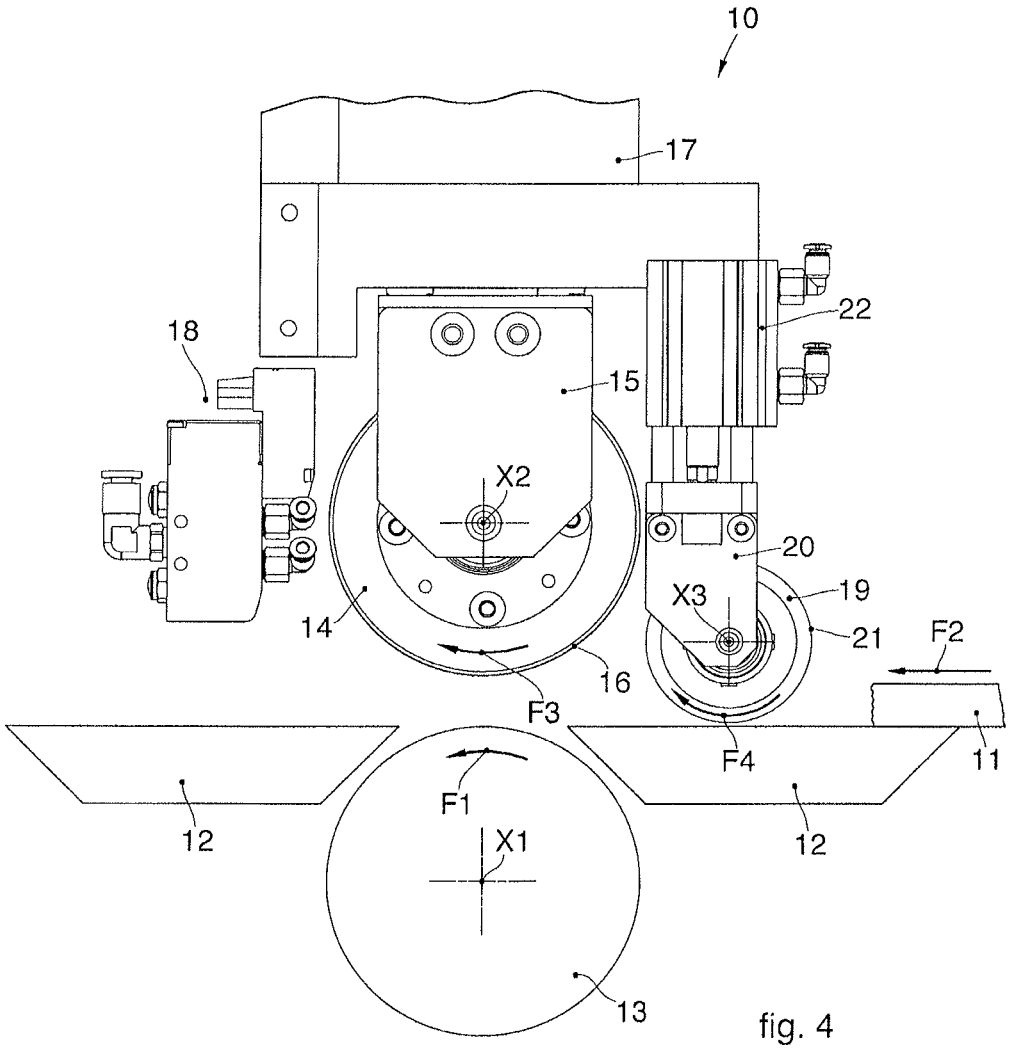
FIG. 4 is a lateral view of the cutting device in FIG. 1 in a third working position.

FIG. 4 shows a third working position of the cutting device 10, with the second cutting disc 19 still lowered, while the first cutting disc 14 has already returned to its inactive position, raised with respect to the support plane 12.

We must point out that, even if it has a slightly higher production cost than known cutting devices, which have only one cutting disc, the cutting device 10, precisely because of the second cutting disc 19, allows to obtain great cutting efficiency and can operate at a much higher cutting speed than known devices, and therefore the cost of the cutting operations is greatly reduced. Furthermore, the cutting device 10, due to what we explained above, also increases the average life of the tools.

It is clear that modifications and/or additions of parts may be made to the cutting device 10 and corresponding cutting method as described heretofore, without departing from the field and scope of the present invention.

For example, the material 11 could remain stationary in a position on the support plane 12 and the two cutting discs 14 and 19 can be moved laterally, in the opposite direction to that indicated by arrow F2, toward the material 11, so that the second cutting disc 19 makes a deep incision on it and then the first cutting disc 14 completes the cutting of the material 11.

It is also clear that, although the present invention has been described with reference to some specific examples, a person of skill in the art shall certainly be able to achieve many other equivalent forms of, having the characteristics as set forth in the claims and hence all coming within the field of protection defined thereby.

The invention claimed is:

1. A cutting device for cutting a relatively rigid material (11), comprising:

a first cutting disc sharpened along its peripheral edge and rotating around a first axis of rotation (X2); and at least a second cutting disc (19) sharpened along its peripheral edge (21) and rotating around a second axis of rotation (X3), wherein said second cutting disc (19) is disposed upstream of said first cutting disc (14) with respect to a direction of feed into said cutting device and is co-planar with said first cutting disc (14), wherein said first cutting disc (14) and said second cutting disc (19) are on a same side and mobile individually or together, with respect to a support plane (12) on which a workpiece to be cut is to be rested, so that a distance between the peripheral edge (16, 21) of each of said cutting discs (14, 19) is selectively adjustable with respect to said support plane (12), and wherein said first cutting disc (14) and said second cutting disc (19) are rotatably mounted on a first (15) and respectively second support slider (20), said first and said second support sliders (15, 20) being mounted on a fixed structure (17) and mobile with respect thereto in a direction perpendicular to the support plane (12) to adjust a distance between the first and the second cutting discs (14, 19) and the support plane (12).

2. The cutting device as in claim 1, wherein said second cutting disc (19) is sharper than said first cutting disc (14).

3. The cutting device as in claim 1, wherein said first cutting disc (14) has a first diameter, a first thickness (S1) and a first cutting angle ($\alpha 1$) of its peripheral edge (16), and wherein said second cutting disc (19) has a second diameter, a second thickness (S2) and a second cutting angle (α2) of its peripheral edge.

4. The cutting device as in claim 3, wherein said first diameter is comprised between about 50 mm and 150 mm, wherein said first thickness (S1) is comprised between 1.5 mm and 3 mm and said first cutting angle (α1) is comprised between about 60° and about 120°, wherein said second diameter is comprised between 25 mm and 100 mm, and wherein said second thickness (S2) is comprised between 0.5 mm and 1 mm and said second cutting angle (α2) is comprised between 10° and 30°.

5. The cutting device as in claim 3, wherein the second cutting disc (19) has the second diameter, the second thickness (S2) and the second cutting angle (α2) of its peripheral edge that are each smaller than the first diameter, the first thickness (S1) and the first cutting angle (α1) of the first cutting disc (14).

6. A cutting method for cutting a relatively rigid material (11), comprising:

a first cutting step, in which said material (11) is cut by a first cutting disc (14) having a sharpened peripheral edge (16) and rotating around a first axis of rotation (X2); and at least a second cutting step, in which said material (11) is cut on a same side as in said first cutting step, before said first cutting step takes place, by a second cutting disc (19) having a sharpened peripheral edge (21), rotating around a second axis of rotation (X3) and disposed in front of, and co-planar with, said first cutting disc (14), wherein a distance between the peripheral edges (16, 21) of the first and the second cutting discs (14, 19) is adjusted with respect to a support plane (12), on which said material (11) to be cut is rested, by moving said first cutting disc (14) and said second cutting disc (19) individually or together, with respect to said support plane (12), and wherein said first cutting disc (14) and said second cutting disc (19) are rotatably mounted on a first (15) and respectively second support slider (20), said first and said second support sliders (15, 20) being mounted on a fixed structure (17) and mobile with respect thereto in a direction perpendicular to the support plane (12) to adjust a distance between the first and the second cutting discs (14, 19) and the support plane (12).

* * * * *